US011031171B2

(12) United States Patent
Suzuki et al.

(10) Patent No.: US 11,031,171 B2
(45) Date of Patent: Jun. 8, 2021

(54) REACTOR

(71) Applicant: TAMURA CORPORATION, Tokyo (JP)

(72) Inventors: Kotaro Suzuki, Nerima-ku (JP); Tsutomu Hamada, Nerima-ku (JP)

(73) Assignee: TAMURA CORPORATION, Tokyo (JP)

( * ) Notice: Subject to any disclaimer, the term of this patent is extended or adjusted under 35 U.S.C. 154(b) by 20 days.

(21) Appl. No.: 16/537,531

(22) Filed: Aug. 10, 2019

(65) Prior Publication Data

US 2019/0362878 A1 Nov. 28, 2019

Related U.S. Application Data

(62) Division of application No. 15/172,107, filed on Jun. 2, 2016, now Pat. No. 10,431,369.

(30) Foreign Application Priority Data

Jun. 5, 2015 (JP) ..... 2015-115225

(51) Int. Cl.
*H01F 27/02* (2006.01)
*H01F 27/06* (2006.01)
*H01F 37/00* (2006.01)

(52) U.S. Cl.
CPC ..... *H01F 27/06* (2013.01); *H01F 27/02* (2013.01); *H01F 37/00* (2013.01)

(58) Field of Classification Search
CPC ..... H01F 27/06; H01F 37/00; H01F 27/02; H01F 27/24
See application file for complete search history.

(56) References Cited

U.S. PATENT DOCUMENTS

2009/0108971 A1* 4/2009 Okamoto ..... H01F 37/00 336/65
2010/0102912 A1* 4/2010 Suzuki ..... H01F 27/266 336/65
2012/0139684 A1* 6/2012 Kobayashi ..... H01F 37/00 336/92
2012/0194311 A1* 8/2012 Suzuki ..... H01F 27/266 336/92

(Continued)

FOREIGN PATENT DOCUMENTS

JP 2004-241475 A 8/2004
JP 2009-099596 A 5/2009

(Continued)

OTHER PUBLICATIONS

Office Action issued for counterpart Japanese Application 2016-112250, issued by the Japan Patent Office dated Aug. 2, 2017.

(Continued)

*Primary Examiner* — Mang Tin Bik Lian

(57) ABSTRACT

A reactor includes: a reactor body having a core; and an installation destination object on which the reactor body is mounted; wherein the reactor body has three fixing portions for fixing the reactor body to the installation destination object, the installation destination object has mount portions for mounting the fixing portions, and the reactor body is fixed to the installation destination object by the fixing portions being mounted on the mount portions.

18 Claims, 10 Drawing Sheets

(56) References Cited

U.S. PATENT DOCUMENTS

| | | | | |
|---|---|---|---|---|
| 2013/0106556 | A1* | 5/2013 | Suzuki | H01F 27/306 336/212 |
| 2013/0249666 | A1* | 9/2013 | Suzuki | H01F 27/263 336/210 |
| 2013/0293335 | A1 | 11/2013 | Yoshikawa | |
| 2014/0159844 | A1* | 6/2014 | Suzuki | H01F 27/24 336/65 |
| 2016/0189846 | A1* | 6/2016 | Miyauchi | H01F 27/22 336/61 |
| 2016/0217899 | A1* | 7/2016 | Miyauchi | H01F 27/22 |

FOREIGN PATENT DOCUMENTS

| | | | |
|---|---|---|---|
| JP | 2011-222741 | A | 11/2011 |
| JP | 2013-229406 | A | 11/2013 |
| JP | 2014-183275 | A | 9/2014 |

OTHER PUBLICATIONS

Office Action issued for counterpart Japanese Application 2016-112250, issued by the Japan Patent Office dated Nov. 7, 2017.

* cited by examiner

REACTOR

CROSS-REFERENCE TO RELATED APPLICATIONS

This application is a divisional of U.S. patent application Ser. No. 15/172,107, filed on Jun. 2, 2016, which claims priority to Japanese Patent Application No. 2015-115225, filed on Jun. 5, 2015, the contents of each of which are incorporated herein by reference in their entirety.

BACKGROUND

1. Technical Field

The present invention relates to a reactor that reduces the necessity for tolerance management in fixing a reactor body to a case.

2. Related Art

Reactors are used for various purposes including those in drive systems of hybrid automobiles or electric automobiles or the like. For example, as a reactor used in a booster circuit mounted in a vehicle, one in which a reactor body comprising: an annular core made with a magnetic material; a resin member covering the outer circumference of the annular core; and a coil wound around a part of the outer circumference of the annular core via the resin member is housed in a metallic case is used often. Molding is generally adopted to arrange resin around the circumference of the annular core to form the resin member.

A conventionally adopted method of fixing a reactor body to a case is performed by housing the reactor body in the case and fixing the reactor body to the case by fastening with a screw (see Japanese Patent Application Publication No. 2013-229406). That is, the reactor body is provided with a metallic fixture provided, at its tip, with a screw hole, and the screw hole and a screw hole provided to the case are aligned and a screw is inset to both the screw holes to fasten the screw holes, thereby fixing the reactor body to the case.

Conventionally, metallic fixtures for fixing a reactor body to a case are provided at four corners of the reactor body, and the reactor body is fixed to the case by screw-fastening at the four locations in total.

Hereinafter, fixation of a reactor body to a case at four locations is called "four-point fixation." In a case of four-point fixation, it is necessary to strictly manage positional tolerance of each fixation location in the reactor body in its height direction. That is, in a case of four-point fixation, if all the four points at the fixation locations are not on the same plane, the reactor body is fixed in a state where distortion is caused to the reactor body, so this may lead to destruction of each member such as a metal plate which is a fixture, for example.

For this reason, in order to perform tolerance management at four points of the above-mentioned reactor body in its height direction, it is necessary to be strict about the dimension of each member, and also it is necessary to use a jig device to press the reactor body against the case highly precisely, leading to cost increase.

Therefore, it is an object of an aspect of the innovations herein to provide a rector, which is capable of overcoming the above drawbacks accompanying the related art.

SUMMARY

One embodiment of the present invention provides a reactor comprising: a reactor body having a core; and an installation destination object on which the reactor body is mounted; wherein the reactor body has three fixing portions for fixing the reactor body to the installation destination object, the installation destination object has mount portions for mounting the fixing portions, and the reactor body is fixed to the installation destination object by the fixing portions being mounted on the mount portions.

DESCRIPTION OF EXEMPLARY EMBODIMENTS

Figure 1:
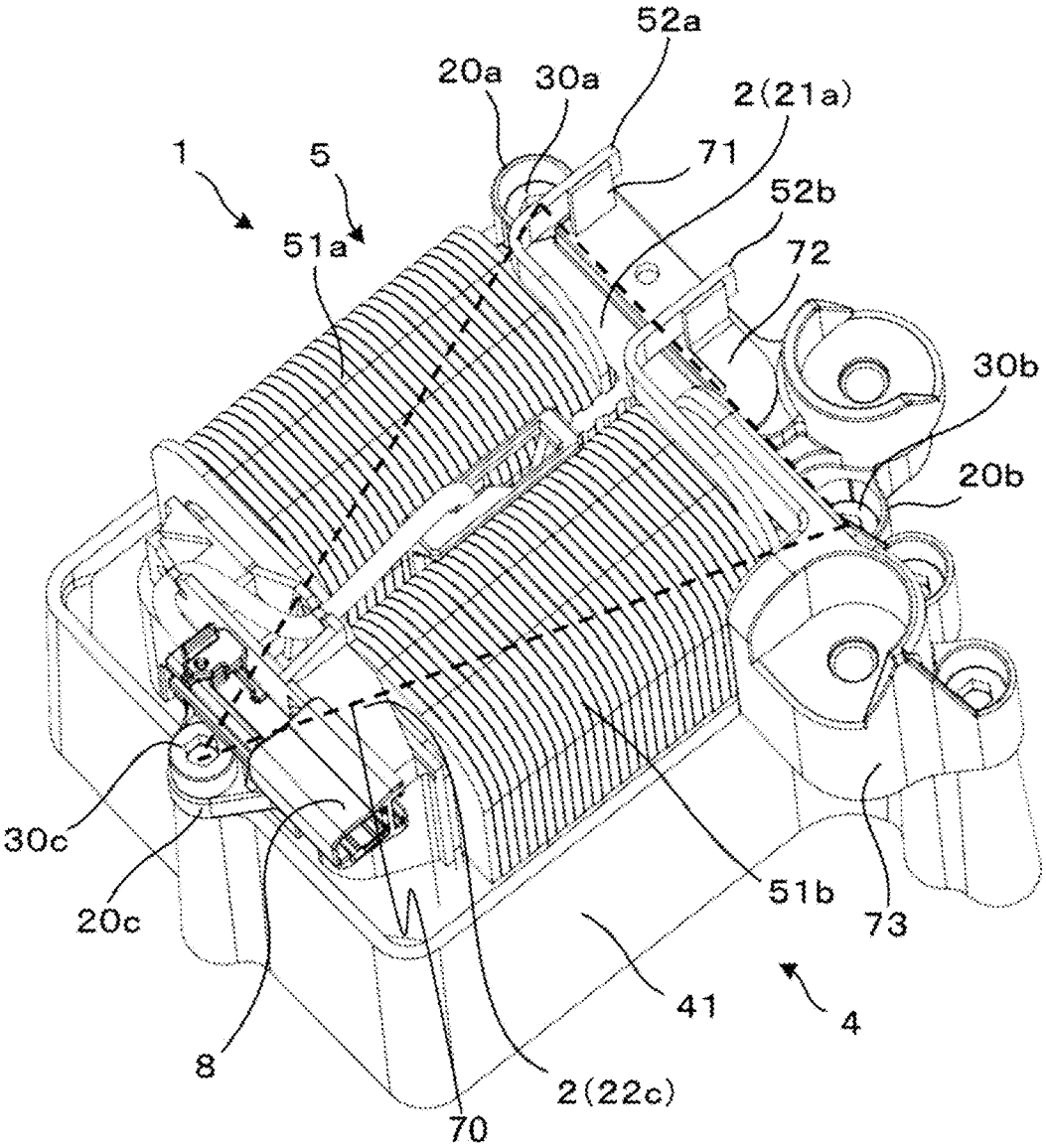
FIG. 1 is a perspective view showing the overall configuration of a reactor in one embodiment of the present invention.

According to one aspect of the present invention, a reactor of the present invention comprises: a reactor body having a core; and an installation destination object on which the reactor body is mounted, and has the following configurations.

(1) The reactor body has three fixing portions for fixing the reactor body to the installation destination object.

(2) The installation destination object has mount portions for mounting the fixing portions.

(3) The reactor body is fixed to the installation destination object by the fixing portions being mounted on the mount portions.

The reactor of the present invention may have the following configurations.

(4) The installation destination object is a case that houses the reactor body, and the case has: sidewalls; and the mount portions that are provided to the sidewalls and are for mounting the fixing portions.

(5) The reactor body has a resin member that covers the circumference of the core, and the resin member is provided with the fixing portions integrally molded continuously from a location covering the core.

(6) The sidewalls are flexible.

(7) The mount portions are provided on top surface portions of the sidewalls, and the case has an opening formed by the sidewalls, the opening deforming due to a linear expansion difference between the reactor body and the case.

(8) The reactor comprises a coil fit to the resin member so as to wind around the circumference of the core; and a bus bar whose one end is electrically connected with the coil and another end is electrically connected with an external device by fastening, wherein two of the fixing portions are provided at both sides of the bus bar.

(9) The case is made with any of aluminum, resin, iron, magnesium and zinc or two or more types of these.

(10) The core is an annular core, the annular core includes: two or more leg portions configured with I-shaped cores; and a pair of yoke portions arranged at both end portions of the leg portions, the three fixing portions are a first fixing portion, a second fixing portion and a third fixing portion, and the third fixing portion is provided to the resin member on a side of one of the yoke portions, and the first fixing portion and the second fixing portion are provided to a resin member on a side of another one of the yoke portions.

(11) The core is an annular core, the annular core includes: two or more leg portions configured with I-shaped cores; and a pair of yoke portions arranged at both end portions of the leg portions, the three fixing portions are a first fixing portion, a second fixing portion and a third fixing portion, the third fixing portion is provided at a central part of the resin member on a side of one of the yoke portions, a length of a line connecting the third fixing portion and the first fixing portion and a length of a line connecting the third fixing portion and the second fixing portion are equal to each other, and one plane formed by the three fixing portions is isosceles triangle-shaped.

(12) The core is an annular core, the annular core includes: two or more leg portions configured with I-shaped cores; and a pair of yoke portions arranged at both end portions of the leg portions, at least one of the fixing portions is formed in a direction extending outward from a bent portion of the yoke portion, and at least one of the mount portions is provided at a corner portion formed by two of the sidewalls, and the fixing portion formed in a direction extending outward from the bent portion is mounted on the at least one of the mount portions.

(13) The core is an annular core, the annular core has: two or more leg portions configured with I-shaped cores; and a pair of yoke portions arranged at both end portions of the leg portions, upper edges of the sidewalls of the case form an approximately quadrangle opening, the three fixing portions are a first fixing portion, a second fixing portion and a third fixing portion, the third fixing portion is fixed to the mount portion arranged at the upper edge of the sidewall opposite to the yoke portion, and the first fixing portion and the second fixing portion are fixed to the mount portions arranged at the upper edge of the sidewall on a side opposite to the sidewall to which the third fixing portion is fixed.

(14) The three fixing portions form one plane which is triangle-shaped and formed by the respective fixing portions as its apexes, and the reactor body is fixed to the installation destination object in a state where the three fixing portions maintain the shape of the one plane.

(15) The core is an annular core, the three fixing portions are a first fixing portion, a second fixing portion and a third fixing portion, the resin member includes: a first joint portion including a straight line portion that covers a pair of straight line parts of the annular core; and a second joint portion that is joined with the first joint portion, the third fixing portion is provided at the first joint portion, and the first fixing portion and the second fixing portion are provided at the second joint portion.

(16) At least one of the fixing portions has an extending portion provided to extend from the resin member, the extending portion is flexible in at least one direction among a height direction of the reactor and a lateral direction vertical to the height direction, and a screw through-hole to be fastened with the mount portion is formed at a tip of the extending portion.

According to one aspect of the present invention, a reactor that allows cost reduction by eliminating necessity for strict tolerance management of the reactor body in its height direction can be realized.

Hereinafter, reactors in embodiments of the present invention are explained with reference to the figures.

1. First Embodiment

1-1. General Configuration

Figure 2:
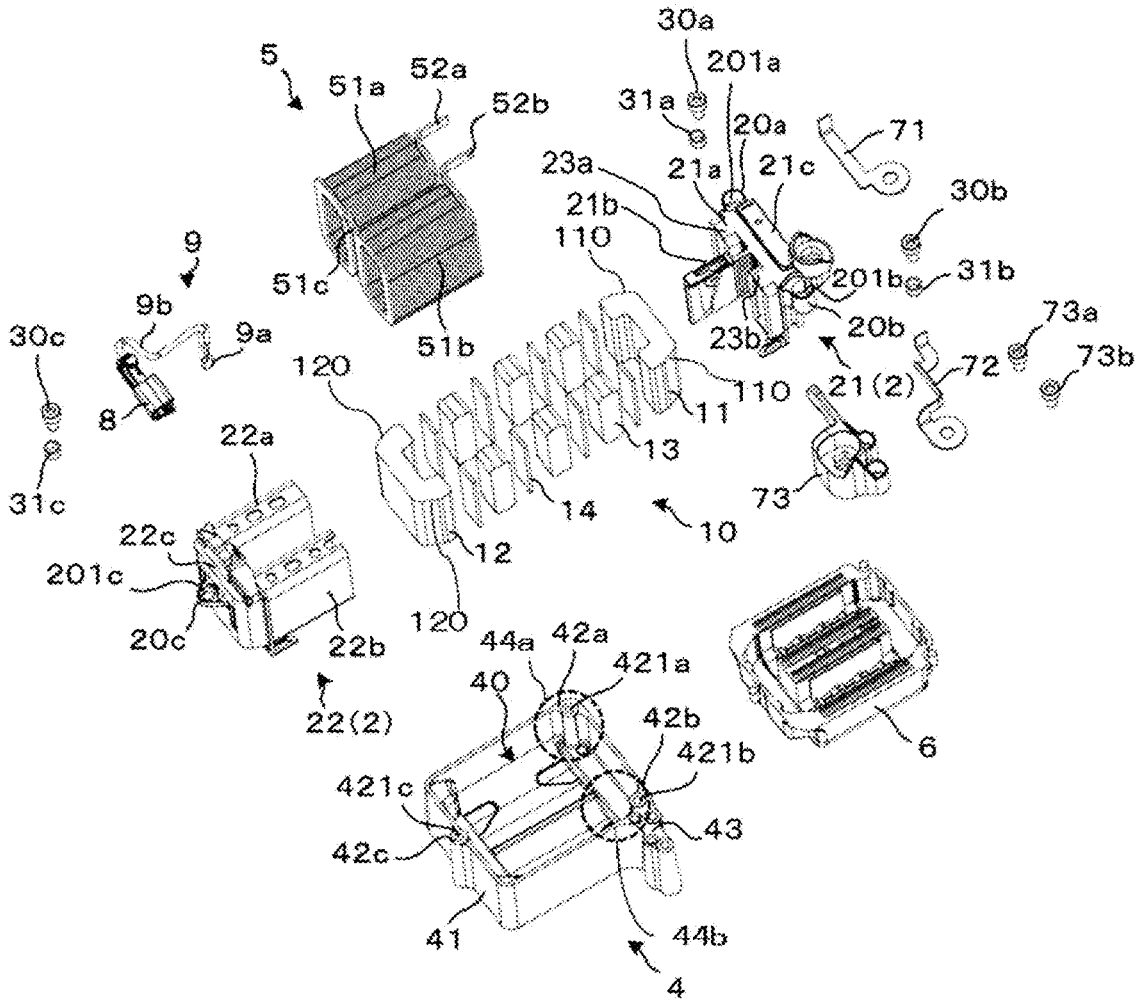
FIG. 2 is an exploded perspective view showing the overall configuration of the reactor in one embodiment of the present invention.
Figure 3:
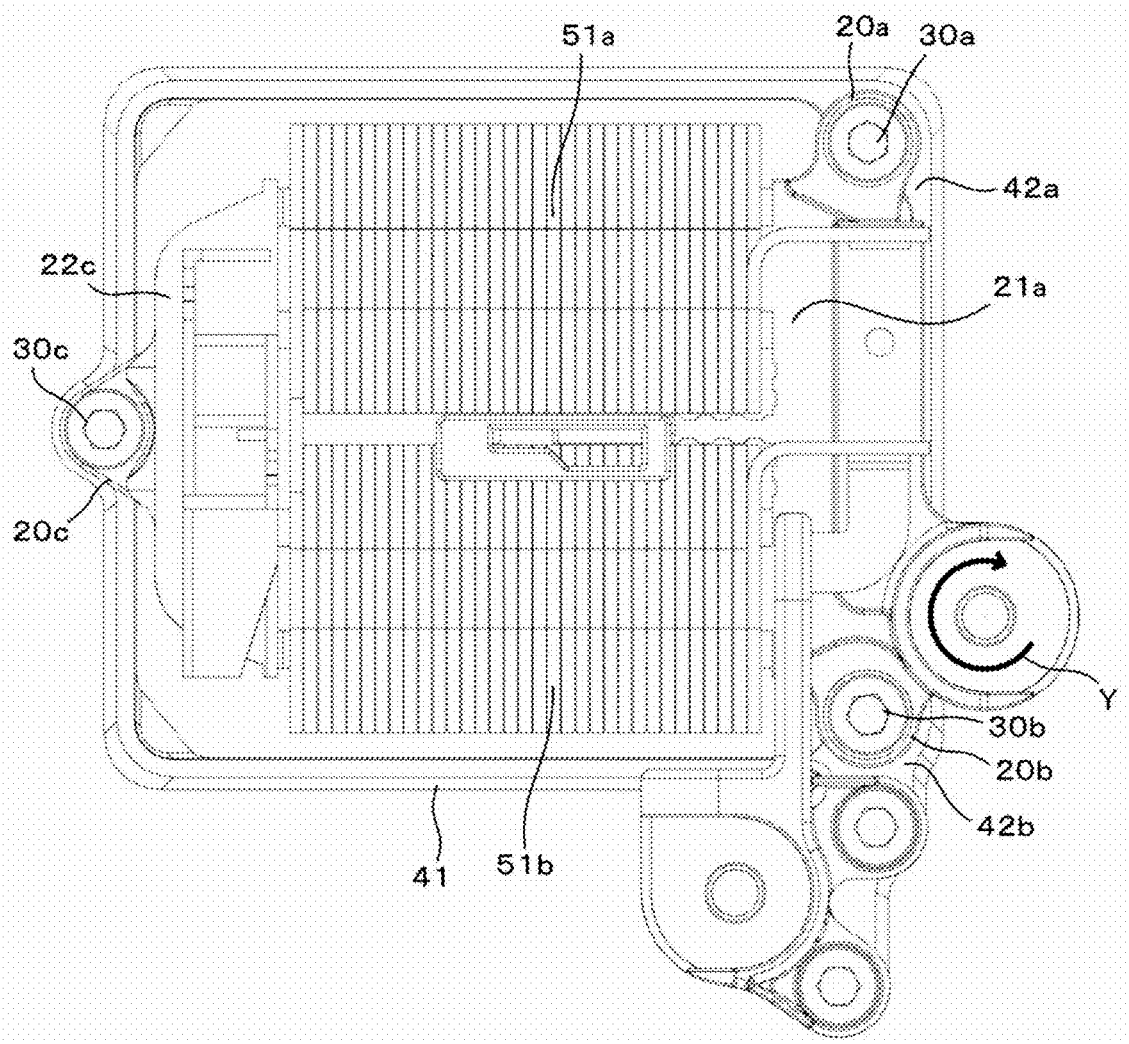
FIG. 3 is a plan view of the reactor in one embodiment of the present invention.

FIG. 1 is a perspective view showing the overall configuration of a reactor according to the present embodiment, and FIG. 2 is an exploded perspective view thereof. FIG. 3 is a schematic view obtained by viewing the reactor according to the present embodiment as a plane. Note that some of the members shown in FIG. 2 are omitted for simplicity.

The reactor is an electromagnetic part that converts an electrical energy into a magnetic energy which is then to be accumulated and released, and the reactor is used for voltage boost and drop or the like. The reactor in the present embodiment is a high capacity reactor used for, for example, a drive system of a hybrid automobile or an electric automobile, or the like. The reactor is a main part of a booster circuit mounted in those automobiles. A booster circuit has, other than a reactor, a semiconductor switching element such as an IGBT. By the semiconductor switching element being turned on and off at high speed, the reactor converts an electrical energy supplied from an external power supply into a magnetic energy, repeats accumulation and release of the energy, and boosts voltage.

As shown in FIG. 1 and FIG. 2, the reactor comprises: a reactor body 1 having an annular core 10; and a case 4 that has an opening 40 and houses the reactor body 1. The reactor is configured with the reactor body 1 being housed and fixed in the case 4. In the present embodiment, the reactor body 1 is installed in the case 4. That is, an installation destination object of the reactor body 1 is not particularly limited, but in the present embodiment, it is the case 4.

The reactor body 1 has: the annular core 10; a coil 5 fit to the outer circumference of a part of the annular core 10; an resin member 2 that covers the outer circumference of the annular core 10, and insulates the annular core 10 from the coil 5; and fixing portions 20*a*, 20*b*, 20*c* for fixing the reactor body 1 to the case 4 which is an installation destination.

The annular core 10 is an annular magnetic body, and as shown in FIG. 2 has, at a part of its annular shape, a pair of parallel straight line parts and U-shaped joint parts linking those straight line parts. In the annular core 10, the straight line parts around which the coil 5 is wound are leg portions at which a magnetic flux is generated. The U-shaped joint parts around which the coil 5 is not wound are yoke portions through which a magnetic flux generated at the leg portions passes. That is, the yoke portions link the pair of straight line parts. By a magnetic flux generated at the leg portions passing through the yoke portions, an annular closed magnetic circuit is formed in the annular core 10.

The resin member 2 covers the outer circumference of the annular core 10, and is annular as a whole like the annular core 10. That is, the resin member 2 has a pair of parallel straight line parts and joint parts that link those straight line parts. In the present embodiment, the resin member 2 is configured with two half portions, and has a resin body 21 and a resin body 22.

The resin body 22 has a pair of straight line portions 22*a*, 22*b*, and a U-shaped joint portion 22*c* that links those straight line portions 22*a*, 22*b*. The straight line portions 22*a*, 22*b* cover the pair of straight line parts of the annular core 10. The joint portion 22*c* covers the U-shaped joint part of the annular core 10. The joint portion 22*c* is one example of a first joint portion. The resin body 21 has a C-shaped joint portion 21*a*. The joint portion 21*a* in the present example has projecting portions 23*a*, 23*b* to be connected with the straight line portions 22*a*, 22*b* of the resin body 22. The joint portion 21*a* is one example of a second joint portion. The projecting portions 23*a*, 23*b* of the resin body 21 are shorter than the straight line portions 22*a*, 22*b* of the resin body 22. The straight line portions 22*a*, 22*b* are parts to which the coil 5 are fit, and are also called bobbins. The pair of straight line portions 22*a*, 22*b* is the pair of straight line parts of the resin member 2, and the joint portions 22*c*, 21*a* are joint parts that link the pair of straight line parts.

In this manner, the reactor body 1 has an annular shape consisting of the pair of parallel straight line parts and the joint parts that link the straight line parts, conforming to the shape of the annular core 10.

Such a reactor body 1 is fixed to the case 4 having an approximately rectangular solid housing space. For this fixation, three fixing portions 20*a*, 20*b*, 20*c* are provided to the reactor body 1.

The fixing portions 20*a*, 20*b*, 20*c* are configured as parts of the resin member 2. That is, the fixing portions 20*a*, 20*b* are provided by integral-molding with the joint portion 21*a* so as to swell from the joint portion 21*a* of the resin body 21 that covers the annular core 10. The fixing portion 20*c* is provided by integral-molding with the joint portion 22*c* so as to swell from the joint portion 22*c* of the resin body 22 that covers the annular core 10. In the present embodiment, the first fixing portion 20*a*, the second fixing portion 20*b* and the third fixing portion 20*c* are arranged in an isosceles triangle-shape as shown in FIG. 3. That is, the first fixing portion 20*a* and the second fixing portion 20*b* are provided at both sides of the joint portion 21*a*, and the third fixing portion 20*c* is provided at a central part of the joint portion 22*c*. Note that both sides of the joint portion 21*a* refer to both ends of the joint portion 21*a* in a direction that is vertical to the direction of straight lines of the straight line portions 22*a*, 22*b* on the plane shown in FIG. 3. Also, the central part of the joint portion 22*c* refers to the central part of the joint portion 22*c* in the vertical direction.

As shown in FIG. 2, the case 4 has a bathtub-shape comprising the opening 40 on its top surface, and comprises the sidewalls 41 provided to stand upward from its bottom portion. Pedestal portions 42*a*, 42*b*, 42*c* on which the first, second and third fixing portions 20*a*, 20*b*, 20*c* are to be placed and which are used to fix the reactor body 1 are provided on the top surfaces (upper edge) of the sidewalls 41. The pedestal portions 42*a*, 42*b*, 42*c* are members to which the reactor body 1 is mounted, and function as mount portions. The pedestal portions 42*a*, 42*b*, 42*c* are arranged in an isosceles triangle-shape such that the first, second and third fixing portions 20*a*, 20*b*, 20*c* can be placed thereon.

Screw through-holes 201*a*, 201*b*, 201*c* are provided at the first, second and third fixing portions 20*a*, 20*b*, 20*c*. Screw holes 421*a*, 421*b*, 421*c* are provided at the pedestal portions 42*a*, 42*b*, 42*c*. The reactor body 1 and the case 4 are fixed by being fastened with screws 30*a*, 30*b*, 30*c* via the screw through-holes 201, 201*b*, 201*c* and the screw holes 421*a*, 421*b*, 421*c* in a state where the first, second and third fixing portions 20*a*, 20*b*, 20*c* are placed on the pedestal portions 42*a*, 42*b*, 42*c*.

Here, in this fixation, the first, second and third fixing portions 20*a*, 20*b*, 20*c* are placed on and fixed to the pedestal portions 42*a*, 42*b*, 42*c* while keeping one plane 70 formed by those three fixing portions 20*a*, 20*b*, 20*c* planar so that excessive distortion or stress is not caused to the reactor body 1.

In the present example, the one plane 70 formed by the three fixing portions 20*a*, 20*b*, 20*c* is maintained before and after fastening of the screws 30*a*, 30*b*, 30*c*. That is, distortion is not caused to the shape of the one plane 70, and also the relative position and inclination of the one plane 70 relative to the reactor body 1 are maintained. As one example, the plane formed by the first, second and third fixing portions 20*a*, 20*b*, 20*c* and the plane formed by the pedestal portions 42*a*, 42*b*, 42*c* are parallel, and in a state where they are fixed, both the planes are positioned on the same plane. Note that, for example, when the three fixing portions 20*a*, 20*b*, 20*c* are regarded as points, the one plane 70 formed by the three fixing portions 20*a*, 20*b*, 20*c* is a plane formed by connecting the respective points at the shortest distances. As one example, the points are the central points of the screw through-holes 201 of the respective fixing portions 20*a*, 20*b*, 20*c* on the surface facing the case 4. In the present example, the three fixing portions 20*a*, 20*b*, 20*c* form the one triangle-shaped plane 70.

A filler is filled and solidified in a clearance between the reactor body 1 and the case 4 so as to form a filler resin portion 6. As the filler, resin which is relatively soft and has high thermal conductivity is suitable for the purpose of ensuring radiation performance of the reactor body 1 and reduction of vibration propagation from the reactor body 1 to the case 4.

1-2. Details of Configuration

Next, each configuration of the reactor in the present embodiment is explained in detail.

1-2-1. Reactor Body (Annular Core)

The annular core 10 is a magnetic body such as a dust core, a ferrite magnetic core or a laminate steel. As shown in FIG. 2, the annular core 10 has core members 11, 12, 13, and a plurality of spacers 14. The spacers 14 are arranged between the respective core members 11, 12, 13, and the core members 11, 12, 13 and the spacers 14 are connected with an adhesive so as to form an annular shape.

The core members in the present embodiment are a plurality of I-shaped cores 13 configuring left and right leg portions, and two U-shaped cores 11, 12 configuring yoke portions. The I-shaped cores 13 are approximately rectangular solid magnetic bodies. The leg portions are formed by laminating the plurality of I-shaped cores 13. Note that the I-shaped cores 13 are not limited to rectangular solids, but may be cylinders, elliptic cylinders or polygons. The U-shaped cores 11, 12 are magnetic bodies having U-shapes. The cross-sectional shapes of the U-shaped cores 11, 12 are squares. The cross-sectional shapes are not limited to squares, but may be polygons, perfect circles or ellipses. Note that the U-shaped cores 11, 12 have shapes having bent portions 110, 120 at which corners, on the outer circumference side, of the cores have been cut off.

The spacers 14 are tabular gap spacers. These spacers 14 are arranged between the respective core members 11, 12, 13, and adhered and fixed to adhesion end surfaces of the core members 11, 12, 13 on both sides of the spacers 14 by an adhesive. The spacers 14 give magnetic gaps with predetermined widths between the core members 11, 12, 13, and prevent inductance on a high electrical current side of the reactor from lowering. A non-magnetic body, a ceramic, a nonmetal, a resin, a carbon fiber, a composite of two or more types of these or a gap paper may be used as a material of the spacers 14. They may be air gaps. Note that the spacers 14 are not necessarily provided.

(Resin Member)

The resin member 2 is a member covering, with its resin, the outer circumference of the annular core 10. Accordingly, the resin member 2 is formed into an annular shape conforming to the shape of the annular core 10. The coil 5 is wound around the outer circumference of a part of the resin member 2, and the resin member 2 insulates the annular core 10 from the coil 5.

Exemplary types of the resin that configures the resin member 2 include, for example, an epoxy resin, an unsaturated polyester resin, a urethane resin, a BMC (Bulk Molding Compound), a PPS (PolyPhenylene Sulfide), a PBT (PolyButylene Terephthalate) or the like.

The resin member 2 is configured with two half portions. That is, the resin member 2 is configured by molding, in advance, the approximately C-shaped resin body 21 and the approximately U-shaped resin body 22 separately, and causing their respective end portions to abut against each other. The resin body 21 and the resin body 22 are molded separately in order to house therein the I-shaped cores 13 configuring the leg portions of the annular core 10 and to fit the coil 5 to the resin member 2 by putting the coil 5 thereinto.

The resin body 22 has the pair of cylindrical straight line portions 22*a*, 22*b*, the joint portion 22*c* linking the straight line portions 22*a*, 22*b*, and the fixing portion 20*c*. The resin body 21 has the approximately C-shaped joint portion 21*a*, a hook 21*b*, a terminal covering portion 21*c*, and the fixing portions 20*a*, 20*b*.

The resin bodies 21, 22 are members integrally molded with resin. That is, the joint portion 21*a*, the hook 21*b*, the terminal covering portion 21*c* and the fixing portions 20*a*, 20*b* configuring the resin body 21 are configured seamlessly and continuously. The straight line portions 22*a*, 22*b*, the joint portion 22*c* and the fixing portion 20*c* configuring the resin body 22 are also similarly configured seamlessly and continuously The U-shaped cores 11, 12 are embedded inside the joint portions 21*a*, 22*c* by molding. In other words, the joint portions 21*a*, 22*c* are covering portions of the U-shaped cores 11, 12, and outer circumference parts of the U-shaped cores 11, 12 that are covered by the joint portions 21*a*, 22*c* fit in the inner circumference of the joint portions 21*a*, 22*c*. Note that the adhesion end surfaces of the U-shaped cores 11, 12 are exposed.

The straight line portions 22*a*, 22*b* are covering portions covering the straight line parts of the annular core 10. That is, the I-shaped cores 13 and the spacers 14 are arranged by being laminated alternately inside the straight line portions 22*a*, 22*b* along the direction of straight lines of the annular core 10. Opening portions are respectively provided at the tips of the straight line portions 22*a*, 22*b*, and the I-shaped cores 13 and the spacers 14 are inserted through the opening portions of the straight line portions 22*a*, 22*b*.

The terminal covering portion 21*c* covers a bus bar 71 arranged to run along the top surface of the U-shaped core 11. The bus bar 71 is described below.

The first, second and third fixing portions 20*a*, 20*b*, 20*c* are provided to form an isosceles triangle on a side portion of the reactor body 1. The first, second and third fixing portions 20*a*, 20*b*, 20*c* are provided to the resin member 2, and provided at both ends of one side of a square formed by the sidewalls 41 of the case 4, and at a position corresponding to a middle point of a side opposite to the one side. In other words, the third fixing portion 20*c* is formed to project outward from a central part of the joint portion 22*c* of the resin body 22 covering the U-shaped core 12 which is a yoke portion. The first fixing portion 20*a* and the second fixing portion 20*b* are formed to project outward from the joint portion 21*a* of the resin body 21 covering the U-shaped core 11 which is a yoke portion. The directions in which the fixing portions project are not particularly limited, and two fixing portions do not have to project in the same direction. Also, the fixing portions may project from any location as long as they are continuous with the resin body 21.

Specifically, in the present embodiment, the first and second fixing portions 20*a*, 20*b* swell from both sides of the joint portion 21*a* covering the core of the resin body 21, and are provided at both sides of the bus bar 71 and to be adjacent to the terminal covering portion 21*c*. In particular, the first and second fixing portions 20*a*, 20*b* are provided around the circumference of a location of the bus bar 71 embedded in the resin body 21, the location being a location to be fastened with wiring of an external device. The third fixing portion 20*c* is provided to swell from a central part of the joint portion 22*c*. The screw through-holes 201*a*, 201*b*, 201*c* for screw-fastening are provided respectively at the first, second and third fixing portions 20*a*, 20*b*, 20*c*. Cylindrical metal or resin collars 31*a*, 31*b*, 31*c* are provided to those screw through-holes 201*a*, 201*b*, 201*c*.

The first, second and third fixing portions 20*a*, 20*b*, 20*c* are placed on the pedestal portions 42*a*, 42*b*, 42*c* of the case 4, and by the screws 30*a*, 30*b*, 30*c* being inset into the screw through-holes 201*a*, 201*b*, 201*c*, the reactor body 1 is fixed to the case 4 by screw-fastening.

The first, second and third fixing portions 20*a*, 20*b*, 20*c* have configurations that improve the strength of fixing the reactor body 1 to the case 4. In the present embodiment, as one example of such configurations, the first, second and third fixing portions 20*a*, 20*b*, 20*c* are molded integrally with the joint portions 21*a*, 22*c* to cover the annular core 10 by using resin. In other words, the first, second and third fixing portions 20*a*, 20*b*, 20*c* are configured as a mass of resin such that it is not deformed as a whole even if a stress is applied thereto. Note that the screw through-holes 201*a*, 201*b*, 201*c* and the collars 31*a*, 31*b*, 31*c* are provided at the first, second and third fixing portions 20*a*, 20*b*, 20*c* as explained above.

The first, second and third fixing portions 20*a*, 20*b*, 20*c* are preferably provided at locations higher than half the height of the reactor body 1 in order to tolerate a linear expansion difference between the reactor body 1 and the case 4. The linear expansion difference is the difference between linear expansion amounts. A linear expansion amount is expressed by: (the linear expansion coefficient of an object)×(the mass of the object)×(a temperature difference). The linear expansion coefficient of the reactor body 1 is for example 10 to $15\times10^{-6}$ considering the annular core 10 and the resin member 2, and the linear expansion coefficient of the case 4, when it is made of aluminum, is for example 20 to $25\times10^{-6}$. Also, the thickness of the first and second fixing portions 20*a*, 20*b* in their height direction are approximately ⅓ of the height of the reactor body 1 such that deformation due to a stress is suppressed. The thicknesses of the first and second fixing portions 20*a*, 20*b* may be ¼ of the height of the reactor body 1 or larger. Also, the thicknesses of the first and second fixing portions 20*a*, 20*b* may be the half or smaller.

Figure 4:
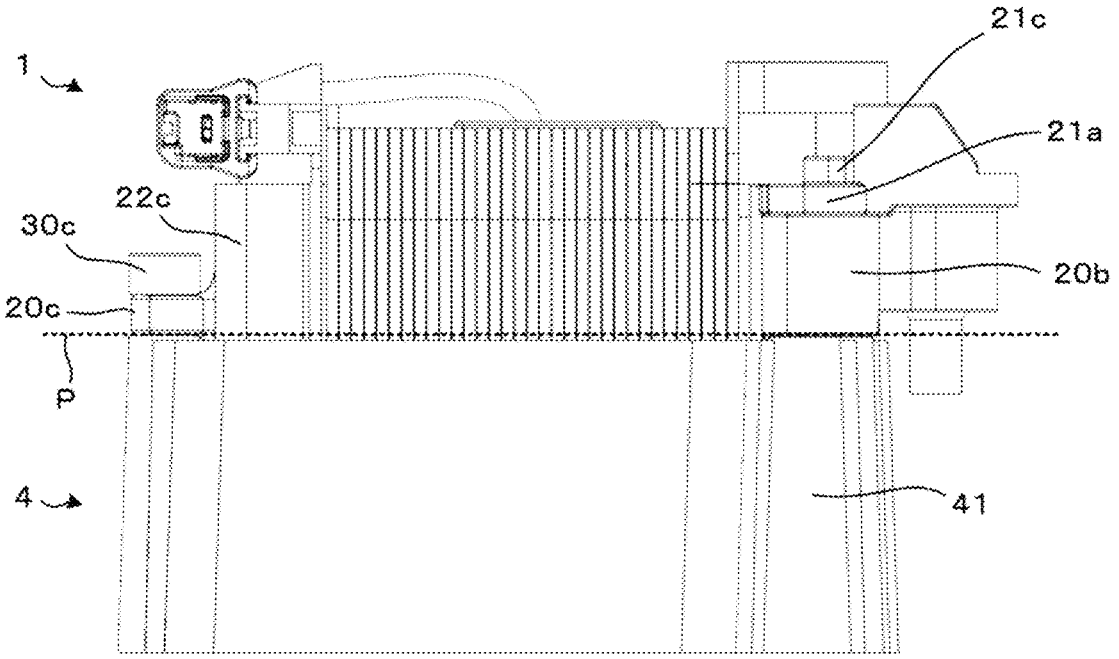
FIG. 4 is a side-view of the reactor in one embodiment of the present invention.

FIG. 4 is a side-view of a reactor. Note that a terminal block 73 described below is not illustrated. As shown in FIG. 4, the first, second and third fixing portions 20*a*, 20*b*, 20*c* are provided on the same plane P. That is, here, the heights of bottom portions of the first, second and third fixing portions 20*a*, 20*b*, 20*c* at which they contact the case 4 are positioned on the same plane P. In the present example, in a state where the reactor body 1 is placed on the case 4, the first, second and third fixing portions 20*a*, 20*b*, 20*c* and the upper edges of the sidewalls 41 of the case 4 are positioned on the same plane P.

The hook 21*b* is provided at the joint portion 21*a* to extend from the joint portion 21*a*, and is used for positioning of a temperature sensor 9 described below. Note that the hook 21*b* may be molded as a member separate from the resin body 21, and may be provided between coils 51*a*, 51*b* in the reactor body 1.

A resin connector 8 that allows connection of another member is provided on the front surface of the joint portion 22*c*. In the present embodiment, the temperature sensor 9 is mounted on this connector 8. As shown in FIG. 2, the temperature sensor 9 consists of a temperature detecting unit 9*a* and a lead wire 9*b* connected to the temperature detecting unit 9*a*.

The temperature detecting unit 9*a* is positioned by the hook 21*b* and arranged between the coils 51*a*, 51*b*, and detects temperature inside the reactor. The lead wire 9*b* is wound around the hook 21*b*, and an end portion of the lead wire 9*b* is mounted on the connector 8 through a positioning through-hole provided at the joint portion 22*c* to convey information on temperature detected by the temperature detecting unit 9*a* to the outside of the reactor. For example, a thermistor whose electric resistance changes according to temperature changes may be used as the temperature sensor 9, but the temperature sensor 9 is not limited thereto.

(Coil)

The coil 5 is a conducting wire having an insulating cover such as enamel. In the present embodiment, the coil 5 is an edge-wise coil made of a rectangular wire. Note that the wire or the manner of winding of the coil 5 is not limited to an edge-wise coil formed with a rectangular wire, and other forms may be adopted.

The coil 5 has the left and right coils 51*a*, 51*b*, and one end portion of each of these is joined by a joining wire 51*c* made of the same material as those of the coils 51*a*, 51*b*. The coil 5 is fit to the outer circumference of the pair of straight line parts of the resin member 2 so that the coils 51*a*, 51*b* wind around the circumference of the annular core 10.

An end portion 52*a* of the coil 51*a* and an end portion 52*b* of the coil 51*b* are drawn out above the joint portion 21*a* of the resin body 21, and are connected to end portions of two bus bars 71, 72 which are connecting terminals. A part of the bus bar 71 is covered by the terminal covering portion 21*c*, and a part of the bus bar 72 is covered by the terminal block 73 made of resin.

The bus bars 71, 72 are configured with bent flat plates, and one end portion of each of them is electrically connected to the end portion 52*a* or 52*b* of the coil 51*a* or 51*b* by welding or the like, and the other end thereof is formed to be circular flat plate-like and is provided with a hole at its center. By using the holes, the bus bars 71, 72 are electrically connected with wiring of an external device such as an external power supply. Upon receiving electrical power supply from the external power supply, electrical current flows through the coils 51*a*, 51*b* so that a magnetic flux that penetrates the coils 51*a*, 51*b* is generated, and an annular closed magnetic circuit is formed in the annular core 10.

1-2-2. Case

Next, the case 4 is explained in detail. The case 4 is bathtub-shaped with the opening 40 formed on its top surface, and houses the reactor body 1. The case 4 has the sidewalls 41 that stand upward from the edge of the bottom portion of the case 4 so as to form a square. The opening 40 is formed by the upper edges of the sidewalls 41, and a housing part of the reactor body 1 is formed by being surrounded by the sidewalls 41 and the bottom portion.

The pedestal portions 42*a*, 42*b*, 42*c* are provided on the top surfaces of the sidewalls 41. The pedestal portions 42*a*, 42*b*, 42*c* have bearing surfaces on which the first, second and third fixing portions 20*a*, 20*b*, 20*c* are to be placed. In the present embodiment, the pedestal portions 42*a*, 42*b* are provided at corners of the case 4, that is, both ends of one side among four sides forming the opening 40 of the case 4. In other words, the pedestal portions 42*a*, 42*b* are provided at corner portions 44*a*, 44*b* having approximately right angle shapes formed by adjacent two sidewalls 41. The pedestal portion 42*c* is provided at a central part of a side that is opposite to the above-mentioned one side. In other words, the pedestal portions 42*a*, 42*b*, 42*c* are arranged in an isosceles triangle-shape similar to the first, second and third fixing portions 20*a*, 20*b*, 20*c*. The plane formed by the pedestal portions 42*a*, 42*b*, 42*c* is parallel to the plane formed by the first, second and third fixing portions 20*a*, 20*b*, 20*c*, and in a state where the reactor body 1 is fixed to the case 4, both the planes are positioned on the same plane. By arranging the three fixing portions in an isosceles triangle-shape, a stress that is applied to each fixing portion can be dispersed, and be prevented from concentrating on one fixing portion. The triangular shape may be an equilateral triangle. By making the lengths of three sides equal to each other, concentration of a stress onto a particular fixing portion can be suppressed.

The case 4 is flexible at least at its sidewalls 41. In the present embodiment, as one means for attaining flexibility, the case 4 is made of aluminum, resin, iron, magnesium or zinc, or at least two types of these. The case 4 may be formed with a metal, such as aluminum alloy, which has a high thermal conductivity and a light weight, for example. The bottom portion of the case 4 may be configured with iron or magnesium which is relatively hard metal, and the sidewalls 41 may be configured with aluminum which is relatively highly flexible.

Also, the heights of the pedestal portions 42*a*, 42*b*, 42*c* are set so as to attain flexibility. In other words, the heights of the pedestal portions 42*a*, 42*b*, 42*c* have heights that allow the opening 40 to tolerate deformation due to a linear expansion difference between the reactor body 1 and the case 4. In order to tolerate deformation due to a linear expansion difference between the reactor body 1 and the case 4, for example, the height of the sidewalls 41 is made tall so that the upper edges of the sidewalls 41 becomes higher than half the height of the reactor body 1, or the thickness of the sidewalls 41 is made as thin as approximately 2 mm, for example. The flexibility may be improved, for example, by providing concavities or holes to the sidewalls 41. When holes are provided to the sidewalls 41, it may be provided at portions higher than the height of the filler resin portion 6. Also, the sidewalls 41 may be formed such that the depth of the housing space that houses the reactor body 1 in the case 4 becomes half the height of the reactor body 1 or larger.

The flexibility of the case 4 may be realized by selecting the above-mentioned materials, by adjusting the heights at which the pedestal portions 42*a*, 42*b*, 42*c* are provided or by adopting both the means. In addition to these, the thickness of the sidewalls 41 may further be considered. In the present embodiment, the pedestal portions 42*a*, 42*b*, 42*c* are provided on the top surfaces of the sidewalls 41 so as to make use of the flexibility of the sidewalls 41.

Note that in a state where the reactor body 1 is housed in the case 4, and the first, second and third fixing portions 20*a*, 20*b*, 20*c* are placed on the pedestal portions 42*a*, 42*b*, 42*c*, a clearance is formed between the circumference of the housed part and the case 4. The reactor body 1 is supported by being caught by the sidewalls 41 of the case 4, and also is supported by the filler resin portion 6 having being filled and solidified in the clearance.

Bearing surfaces of the pedestal portions 42*a*, 42*b*, 42*c* are provided with the screw holes 421*a*, 421*b*, 421*c*, which are aligned with the screw through-holes 201*a*, 201*b*, 201*c* of the first, second and third fixing portions 20*a*, 20*b*, 20*c* and fastened with the screws 30*a*, 30*b*, 30*c*. Note that the case 4 is provided with a pedestal portion 43 that extends therefrom and on which the terminal block 73 provided with the bus bar 72 is installed, and the terminal block 73 is fixed to it by fastening of bolts 73*a*, 73*b*.

[2. Second Embodiment] The second embodiment is a form in which positions of the fixing portions and the pedestal portions are changed from those in the first embodiment. The second embodiment is the same as the first embodiment in that an annular core is formed by U-shaped cores and I-shaped cores, a plurality of cores is incorporated into two resin members, and the two resin members are combined to form the annular core. Therefore, differences from the first embodiment are explained here.

Figure 6:
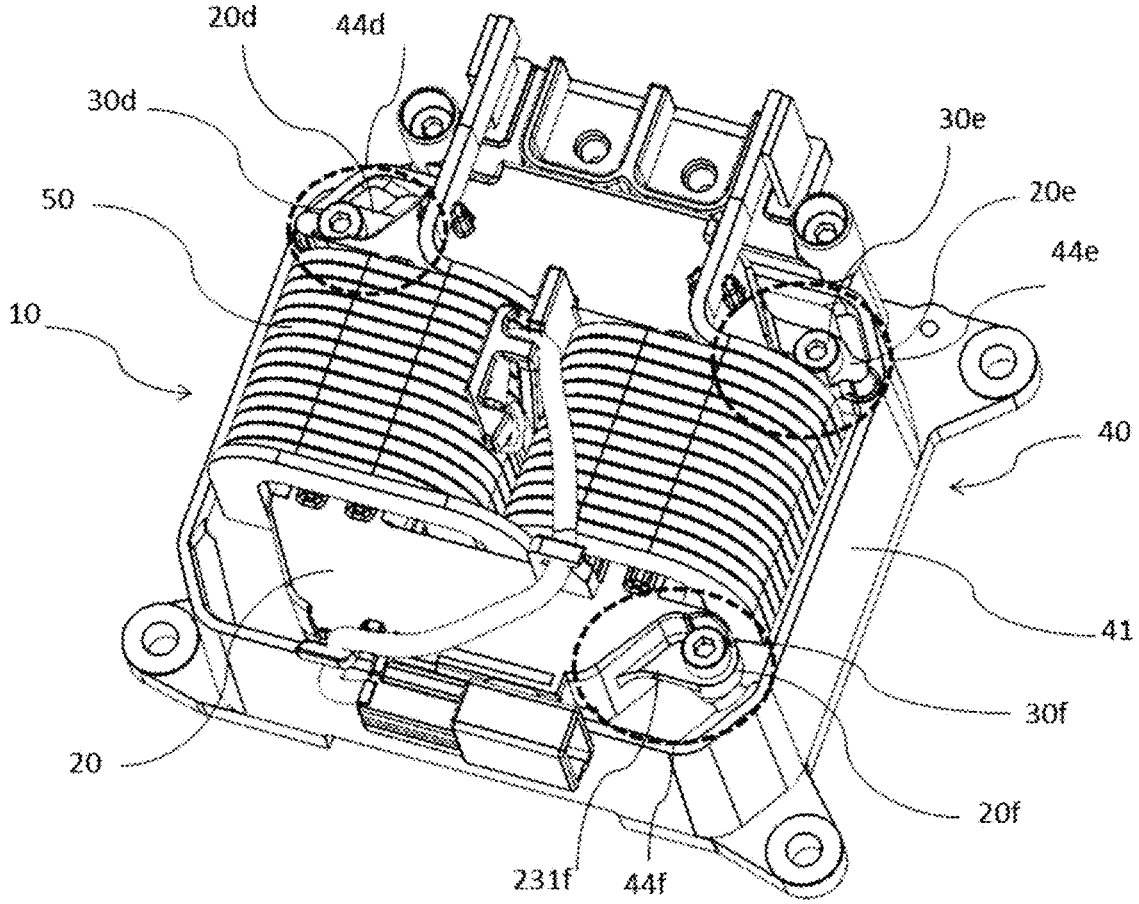
FIG. 6 is a perspective view showing the overall configuration of the reactor in one embodiment of the present invention.
Figure 7A:
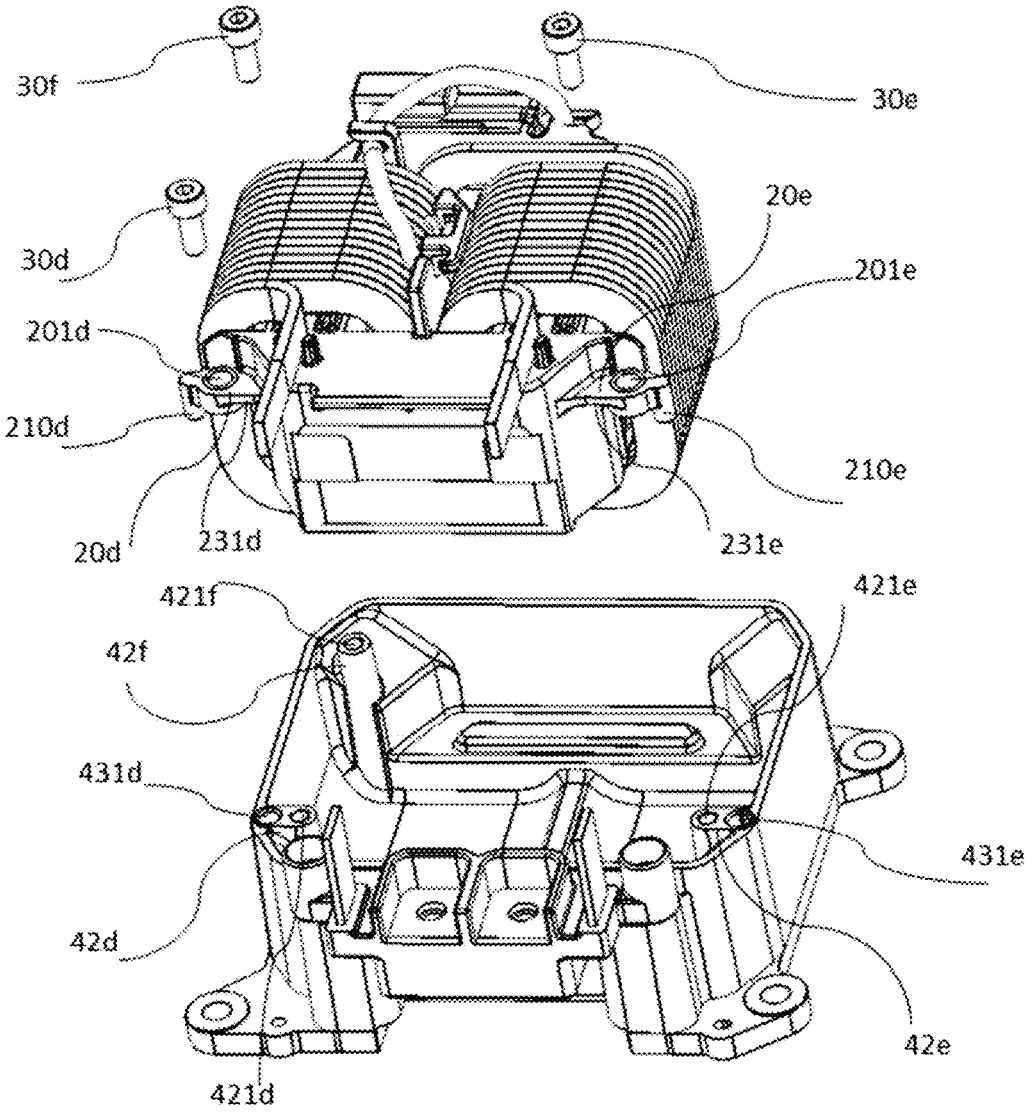
FIG. 7A is an exploded perspective view showing the overall configuration of the reactor in one embodiment of the present invention.

As shown in FIG. 6 and FIG. 7A, the core of the reactor 10 is covered with a resin member, and first, second and third fixing portions 20*d*, 20*e*, 20*f* formed integrally with the resin member are provided. The first, second and third fixing portions 20*d*, 20*e*, 20*f* are provided with extending portions 231*d*, 231*e*, 231*f* formed by extending the resin member 20 from the resin member, and are provided with screw through-holes 201*d*, 201*e*, 201*f* at their tips. However, it is not necessary to provide the extending portions at the fixing portions. Also, the extending portions may be provided only at some of the fixing portions, and the lengths of the extending portions of some of the fixing portions may be different. As one example, an extending portion is not provided at the third fixing portion 20*c* in the first embodiment shown in FIG. 3, or an extending portion of the third fixing portion 20*c* is shorter than extending portions of the other fixing portions. Note that the second embodiment is similar to the first embodiment in that cylindrical collars are provided to the screw through-holes. Pedestal portions 42*d*, 42*e*, 42*f* are provided at corner portions 44*d*, 44*e*, 44*f* of a case 40. The pedestal portions 42*d*, 42*e* are formed by portions of the sidewalls 41 of the case 40 that are projecting toward the inside of the case, and are provided, at their tips, with screw holes 421*d*, 421*e*. Also, the pedestal portion 42*f* is provided with a screw hole 421*f*. The screw holes 421*d*, 421*e*, 421*f* are aligned with screw through-holes 201*d*, 201*e*, 201*f* to be fastened with screws 30*d*, 30*e*, 30*f*. Note that in the present embodiment, the resin members at the parts corresponding to bent portions 110, 120 of the U-shaped cores 11, 12 and the sidewalls 41 facing them are formed to be approximately parallel so as to avoid formation of a dead space between the sidewalls and the resin member as much as possible.

At the first and second fixing portions 20*d*, 20*e*, protruding portions 210*d*, 210*e* are provided near the screw through-holes 201*d*, 201*e*. The protruding portions 210*d*, 210*e* in the present example project in the height direction of the reactor 10. The protruding portions 210*d*, 210*e* project toward the case 4 side past the extending portions 231*d*, 231*e*. Also, at the pedestal portions 42*d*, 42*e*, positioning holes 431*d*, 431*e* are provided near the screw holes 421*d*, 421*e* and at top portions of the sidewalls 41. By the protruding portions 210*d*, 210*e* being inserted into the positioning holes 431*d*, 431*e*, positioning of the reactor 10 relative to the case 40 can be easily performed when housing the reactor 10 in the case 40. Also, by providing the extending portions 231*d*, 231*e*, 231*f* to fix the fixing portions to the pedestal portions, it becomes possible to absorb vibration generated by the reactor or vibration from the outside, and disperse a stress applied to the fixing portions.

Figure 7B:
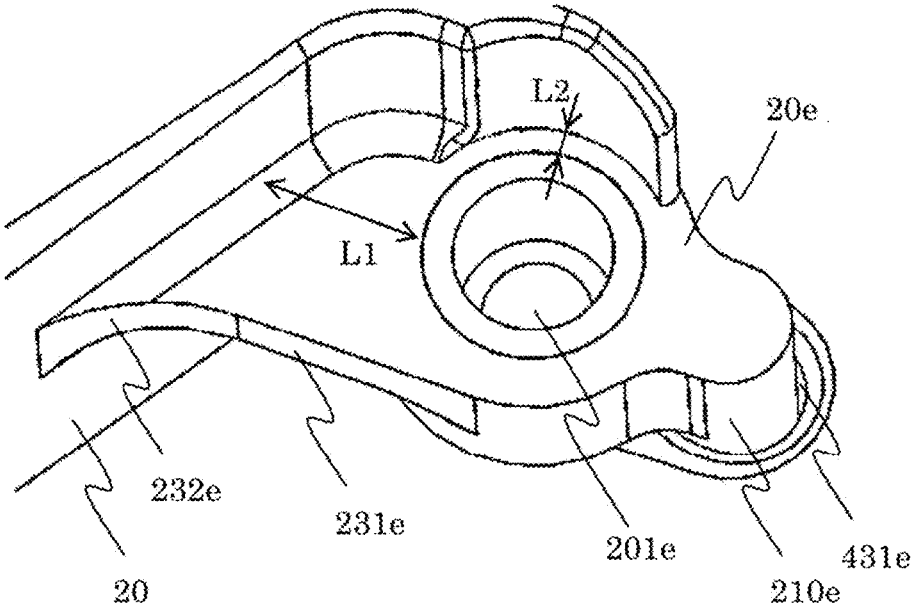
FIG. 7B is a partial perspective view showing an extending portion in one embodiment of the present invention.

FIG. 7B is a partial perspective view showing the extending portion 231*e*. Note that although FIG. 7B shows the extending portion 231*e*, the extending portions 231*d*, 231*f* also have structures similar to that of the extending portion 231*e*. The extending portion 231*e* in the present example is flexible in at least one direction among the height direction of the reactor 10 and the lateral direction vertical to the height direction. The extending portion 231*e* in the present example is more flexible in the height direction than in the lateral direction. By providing the extending portion 231*e*, it becomes possible to absorb the above-mentioned vibration of the reactor or the like or disperse a stress.

Note that the width of an edge portion provided around the circumference of the screw through-hole 201*e* in the fixing portion 20*e* is defined as L2. The width L2 in the present example is a minimum value of the width of the edge portion around the circumference of the screw through-hole 201*e*. A length L1 of at least a part of the extending portion 231 is larger than the width L2 of the edge portion. The length L1 may be twice as large as the width L2 or larger, or may be three times as large as the width L2 or larger. Note that the length of the extending portion 231*e* refers to the distance between an end portion of the screw through-hole 201*e* and the resin member 20.

The extending portion 231*e* in the present example has a region 232*e* curved in the height direction of the reactor 10. Also, the extending portion 231*e* in the present example is thinner than a part of the fixing portion 20*e* at which the screw through-hole 201*e* is formed. Thereby, it becomes easier for the extending portion 231*e* to absorb vibration or the like.

1-3. Effects (1) The reactor in the present embodiment comprises:

a reactor body 1 having an annular core 10; and a case 4 which is an installation destination object on which the reactor body 1 is mounted, wherein the reactor body 1 has:

three fixing portions 20*a*, 20*b*, 20*c* (20*d*, 20*e*, 200 for fixing the reactor body 1 to the case 4; and one plane formed by the three fixing portions 20*a*, 20*b*, 20*c* (20*d*, 20*e*, 20*f*), the case 4 which is the installation destination object has pedestal portions 42*a*, 42*b*, 42*c* (42*d*, 42*e*, 420 for mounting the fixing portions 20*a*, 20*b*, 20*c* (20*d*, 20*e*, 20*f*), and the reactor body 1 is fixed by the fixing portions 20*a*, 20*b*, 20*c* (20*d*, 20*e*, 200 being mounted on the pedestal portions 42*a*, 42*b*, 42*c* (42*d*, 42*e*, 420 while keeping the one plane. In particular, the case 4 has: sidewalls 41; and the pedestal portions 42*a*, 42*b*, 42*c* (42*d*, 42*e*, 420 that are provided to the sidewalls 41 and are for mounting the fixing portions.

Thereby, the number of the fixing portions 20*a*, 20*b*, 20*c* (20*d*, 20*e*, 20*f*) fixed to the pedestal portions 42*a*, 42*b*, 42*c* (42*d*, 42*e*, 420 on the top surfaces of the sidewalls 41 of the case 4 becomes three, and the fixing portions 20*a*, 20*b*, 20*c* (20*d*, 20*e*, 200 result in being positioned on the same plane, so fixing points are never not on one plane unlike in a case of so-called four-point fixation. Accordingly, because the reactor body 1 is fixed to the pedestal portions 42*a*, 42*b*, 42*c* (42*d*, 42*e*, 420 of the case 4 without twisting the one plane formed by the three fixing portions 20*a*, 20*b*, 20*c* (20*d*, 20*e*, 200, an excessive stress is never applied to the reactor body 1. That is, necessity for managing tolerance of the reactor body 1 in the height direction can be removed. Accordingly, a costly jig device that has been necessary in a case of four-point fixation and a member whose tolerance is strictly managed needs not be provided, so cost reduction becomes possible. Specifically, while in a case of four-point fixation, tolerance of ±0.2 mm is necessary, in a case of three-point fixation, tolerance management becomes unnecessary as long as differences are within a range that does not exceed a minimum gap between the case 4 and the reactor body 1 housed in the case 4 (for example, ±1 mm).

(2) The reactor body 1 has a resin member 2 that covers the circumference of the annular core 10, and the resin member 2 is provided with the fixing portions 20*a*, 20*b*, 20*c* (20*d*, 20*e*, 200 integrally molded continuously from the joint portions 21*a*, 22*c* that cover the annular core 10.

Along with reduction in the number of fixation locations from four (as in conventional techniques) to three, the anti-vibration property may become disadvantageous in some cases when external vibration is applied, as compared with cases where the same external vibration is applied to four-point fixation. In the present embodiment, the fixing portions 20*a*, 20*b*, 20*c* (20*d*, 20*e*, 200 are provided by being integrally molded continuously with the resin member 2 from locations that cover the annular core 10 of the resin member 2. Thereby, the rigidity can be improved, and the anti-vibration property can be enhanced. That is, in a case of conventional fixation methods, as shown in FIG. 5, a hole provided to the tip of a thin metallic plate 500 is fixed by being fastened with a screw, and the fixation strength does not pose an issue even if the rigidity of the metal plate is not high because the number of fixation locations is lager by one; however, in the present embodiment, a sufficient fixation strength can be attained even with three fixation locations because the fixing portions 20*a*, 20*b*, 20*c* (20*d*, 20*e*, 200 are provided directly to the resin member 2 covering the annular core 10.

Figure 5:
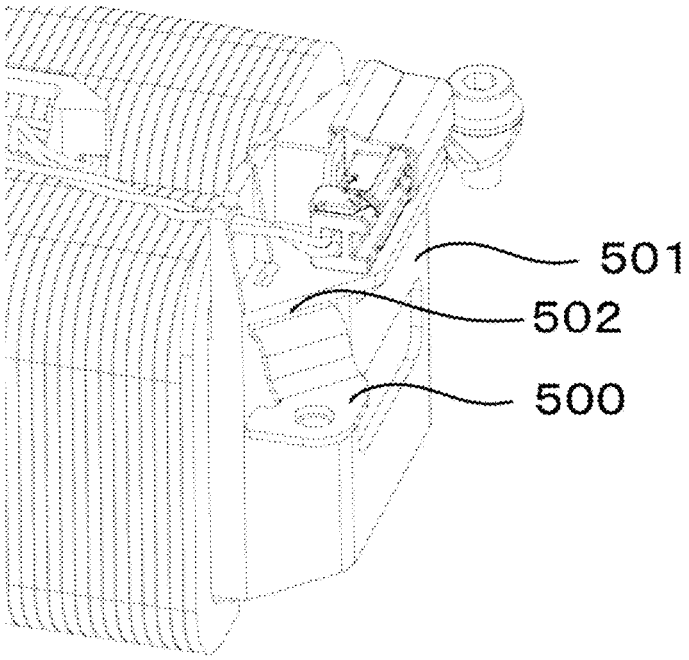
PRIOR ART FIG. 5
FIG. 5 is a partial perspective view of a conventional reactor.

Also, in conventional fixation methods that use thin metallic plates, as shown in FIG. 5, the metal plate 500 is provided to extend from a resin member 501 covering a core, and a stress is concentrated at a root part 502 of the metal plate 500 so that cracks are generated in the resin member 501 or the resin member 501 is deformed, thereby lowering the fixation strength. Also, in some cases, the root part 502 experiences metal fatigue, and rupture occurs to the metal plate 500. In contrast, according to the present embodiment, rupture due to metal fatigue does not occur because the metal plate 500 is not used. For this reason, only the strength of the resin member 2 needs to be considered, and this is advantageous in terms of designing. Also, because there are no longer locations at which a stress concentrates, lowering of fixation strength can be suppressed.

(3) The sidewalls 41 are flexible. Thereby, the sidewalls 41 warp even when there is a linear expansion difference generated between the reactor body 1 and the case 4. In other words, because the shape of the opening 40 is deformed, generated linear expansion can be absorbed. That is, because the reactor body 1 and the case 4 are in a fixed relationship, when a linear expansion difference is generated, a stress is applied to the reactor body 1, and distortion or twist may be generated; however, a stress due to the linear expansion difference is applied to the case 4 due to the flexibility of the sidewalls 41. Accordingly, according to the present embodiment, while attaining cost reduction due to reduction of the necessity for tolerance management and a rigid fixed relationship, an effect of reducing a stress applied to the reactor body 1 can be obtained. For example, an effect of making it difficult for adhesion of the core members 11, 12, 13 of the annular core 10 to come off can be attained, and an anti-vibration property can be improved. The reactor installed on an automobile has to withstand conditions of extreme temperature differences. For example, there are cases where the case 40 or the reactor 10 contract at a temperature below the freezing point or the case 40 or the reactor 10 expands at a high temperature of 100° C. or higher. By adopting configuration in the present embodiment under such temperature conditions, it becomes possible to absorb linear expansion differences, and adhesion of the core members 11, 12, 13 can be prevented from coming off.

(4) The pedestal portions 42*a*, 42*b*, 42*c* (42*d*, 42*e*, 420 are provided at top surface portions of the sidewalls 41, and a height of the sidewalls 41 is a height that deforms an opening 40 due to a linear expansion difference between the reactor body 1 and the case 4. Thereby, application, to the reactor body 1, of a stress due to a generated linear expansion difference can be reduced.

(5) The reactor comprises: a coil 5 fit to the resin member 2 so as to wind around the circumference of the annular core 10; and a bus bar 71 whose one end is electrically connected with the coil 5 and the other end is electrically connected with an external device by fastening, wherein two of the fixing portions 20*a*, 20*b* (20*d*, 20*e*) are provided to be adjacent to each other and to sandwich both sides of the bus bar 71. Thereby, for example, even in a case where when an external device is fastened to a reactor, a torque is generated around the fastening location as shown with the arrow Y in FIG. 3, a stress to be applied to the reactor body 1 can be reduced because fixing portions are provided at both sides of the bus bar 71, and distortion of the reactor body 1 can be suppressed.

(6) At least the sidewalls 41 of the case 4 are made with a material consisting of any of aluminum, resin, iron, magnesium and zinc or two or more types of these. Thereby, flexibility can be imparted to the sidewalls 41 of the case 4, so the opening 40 of the case 4 can be deformed more easily. As a result, it becomes possible to absorb linear expansion differences easily.

(7) The approximately U-shaped cores 11, 12 have shapes whose corners facing corner portions of the case 4 are cut off. The locations at which corners of the core are cut off and the corner portions of the case 4 become dead spaces. By arranging the fixing portions 20*a*, 20*b* (20*d*, 20*e*, 200 at these parts, the pedestal portions 42*a*, 42*b* (42*d*, 42*e*, 420 can be provided inside the case 4 Thereby, it becomes unnecessary to provide pedestal portions outside the case, and becomes possible to reduce the overall size of the reactor.

[2. Other Embodiments] The present invention is not limited to the first and second embodiments, but covers other embodiments shown below. Also, the present invention covers forms obtained by combining the other embodiments explained below.

(1) Although in the first and second embodiments, an installation destination in which the reactor body 1 is installed is the case 4, it is not limited to the case 4, but may be any object in which the reactor body 1 can be installed. For example, the reactor body 1 may be installed directly on a level mount or may be installed directly on a roof or a wall. The heights of the resin members of the fixing portions may be configured to extend relative to the mount so as to reach the mount. Alternatively, a stud may be stood from the mount to function as a pedestal portion, and may be fixed with the fixing portions. The stud may be configured with a material similar to that of the mount. Other than this, the reactor body 1 may be installed on the case 4 mounted on a roof or a wall. In such a case, the case 4 is upside down or inclined.

(2) Although in the first and second embodiments, the heights of the first, second and third fixing portions 20*a*, 20*b*, 20*c* (20*d*, 20*e*, 20*f*) are the same, they do not have to be the same as long as the reactor body 1 can be fixed to the case 4 while maintaining the plane formed by first, second and third fixing portions 20*a*, 20*b*, 20*c* (20*d*, 20*e*, 20*f*) as a plane without twisting it. For example, even if the plane formed by the first, second and third fixing portions 20*a*, 20*b*, 20*c* (20*d*, 20*e*, 200 is inclined relative to the horizontal plane, the plane formed by the pedestal portions 42*a*, 42*b*, 42*c* (42*d*, 42*e*, 420 of the case 4 may be made parallel to the plane formed by the first, second and third fixing portions 20*a*, 20*b*, 20*c* (20*d*, 20*e*, 200. In this case, the respective heights of the fixing portions and the respective heights of the pedestal portions may be changed as needed.

(3) Although in the first and second embodiments, the two fixing portions 20*a*, 20*b* (20*d*, 20*e*) are arranged on both sides of the bus bar 71, the arrangement of the fixing portions 20*a*, 20*b* (20*d*, 20*e*) is not limited thereto. The fixing portions 20*a*, 20*b*, 20*c* (20*d*, 20*e*, 200 can be arranged at positions where a minimum moment is attained. The fixing portions 20*a*, 20*b*, 20*c* (20*d*, 20*e*, 200 are arranged at positions that minimize a moment applied to the reactor body 1 due to a running torque generated at the time when wiring of an external device is fastened and fixed to circular flat plate-like parts of the bus bars 71, 72. For example, they may be arranged in a isosceles triangle-shape as in the first embodiment, or each of the fixing portions 20*a*, 20*b*, 20*c* may be arranged at three sides of a square formed by the sidewalls 41. Also, any of the fixing portions 20*a*, 20*b*, 20*c* may be provided around the circumference of the end portion to which wiring of an external device of the bus bar 71 is fastened and fixed. The positions of the fixing portions 20*a*, 20*b*, 20*c* (20*d*, 20*e*, 200 may be changed as needed according to positions where the bus bars 71, 72 are provided.

(4) Although in the first embodiment, the pedestal portions 42*a*, 42*b*, 42*c* are provided on the top surfaces of the sidewalls 41, but the arrangement of the pedestal portions 42*a*, 42*b*, 42*c* is not limited thereto. For example, the pedestal portions 42*a*, 42*b*, 42*c* may be provided inside the case 4, that is, at side parts of the sidewalls 41.

(5) Although in the first and second embodiments, and in the above-mentioned other embodiments, the U-shaped cores 11, 12 and the I-shaped cores 13 are used as core members for configuring the annular core 10, the configuration is not limited thereto. That is, the annular core 10 may by any member that is configured by causing a plurality of core members to abut against each other, and as core members, cores having shapes, such as E-shaped cores, T-shaped cores, J-shaped cores or cores having other shapes, that can configure the annular core 10 can be used. Without using I-shaped cores, an annular core configured by causing end portions of a pair of U-shaped cores or a pair of E-shaped cores to abut against each other may be used.

(6) Although in the first and second embodiments, and the above-mentioned other embodiments, the annular core 10 having one ring is used, the annular core 10 formed, by using cores having three or more leg portions like E-shaped cores, into a 0 shape having two rings may be used.

Figure 8A:
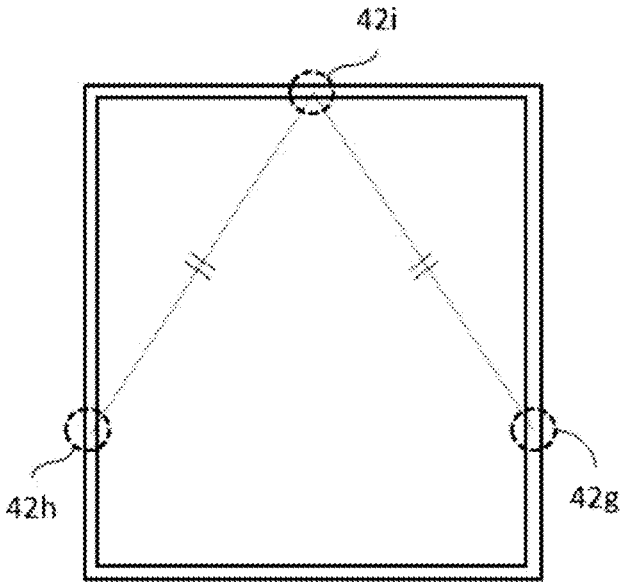
FIG. 8A is a plan view showing a form of arrangement of the pedestal portion of a case in one embodiment of the present invention.
Figure 8B:
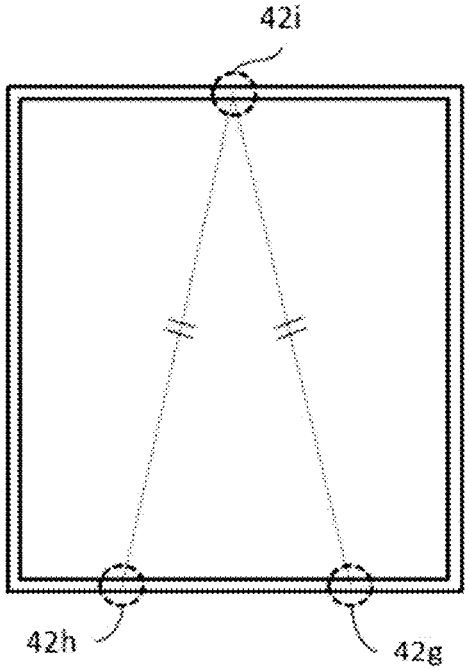
FIG. 8B is a plan view showing a form of arrangement of the pedestal portion of the case in one embodiment of the present invention.
Figure 8C:
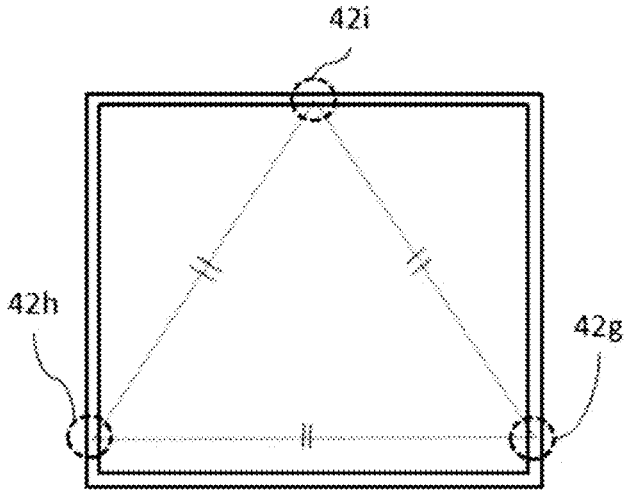
FIG. 8C is a plan view showing a form of arrangement of the pedestal portion of the case in one embodiment of the present invention.
Figure 8D:
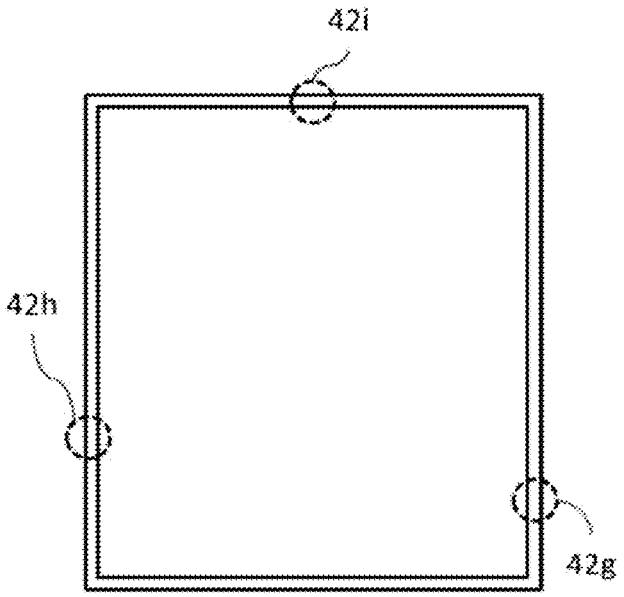
FIG. 8D is a plan view showing a form of arrangement of the pedestal portion of the case in one embodiment of the present invention.
Figure 8E:
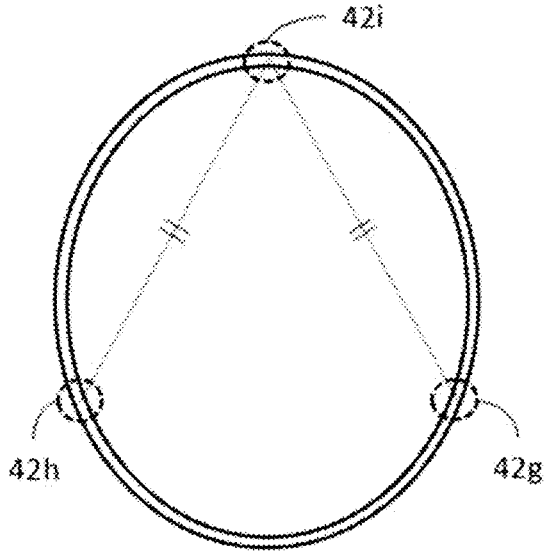
FIG. 8E is a plan view showing a form of an opening consisting of a sidewall of the case in one embodiment of the present invention.
Figure 8F:
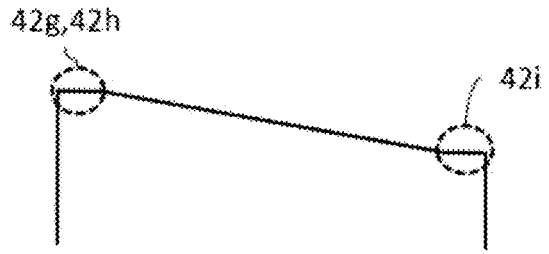
FIG. 8F is a side-view showing a form in which heights of the pedestal portions are different in one embodiment of the present invention.

(7) The locations where the three pedestal portions are arranged may be those as shown in FIG. 8A, FIG. 8B, FIG. 8C, FIG. 8D, FIG. 8E and FIG. 8F, for example. The fixing portions may be arranged according to the arrangement of the pedestal portions. As shown in FIG. 8A, two pedestal portions 42*g*, 42*h* may be provided on a sidewall that is not opposite to a sidewall to which one pedestal portion 42*i* is provided. Also, the distance between the pedestal portions 42*i* and 42*h* and the distance between the pedestal portions 42*i* and 42*g* may be made equal to each other. As shown in FIG. 8B, the two pedestal portions 42*g*, 42*h* may be provided to a sidewall that is opposite to a sidewall to which the one pedestal portion 42*i* is provided, and the two pedestal portions 42*g*, 42*h* may be provided near the center on the top surface of the former sidewall. Similar to FIG. 8A, the distances between two points may be equal to each other. As shown in FIG. 8C, the distances between all the combinations of two among the three pedestal portions 42*g*, 42*h*, 42*i* may be made equal to each other. FIG. 8D shows a form in which the two pedestal portions 42*g*, 42*h* shown in FIG. 8A are not provided at the same positions on opposite sidewalls. In this manner, they may not form an isosceles triangle-shape. As shown in FIG. 8E, an opening formed by the upper edge of the sidewall of the case may have an elliptic shape. As shown in FIG. 8F, the height of the pedestal portion 42*i* may be different from those of the pedestal portions 42*g*, 42*h*. Fixation between the fixing portions and the pedestal portions may be fixation by means other than screw-fastening.

What is claimed is:

1. A reactor comprising:

a reactor body having a core and a resin member that covers a circumference of the core; and an installation destination object on which the reactor body is mounted; wherein the reactor body has three fixing portions for fixing the reactor body to the installation destination object, at least one of the fixing portions having an extending portion formed by extending the resin member, the installation destination object has mount portions for mounting the fixing portions, the extending portion is flexible in at least one direction among a height direction of the reactor and a lateral direction vertical to the height direction, a screw through-hole to be fastened with the mount portion is formed at a tip of the extending portion, the reactor body is fixed to the installation destination object by the fixing portions being mounted on the mount portions, at least a portion of the extending portion is longer than a minimum width of an edge portion around the screw through-hole formed in the extending portion, and the edge portion around the screw through-hole is thicker than any other portion of the extending portion.

2. The reactor according to claim 1, wherein the installation destination object is a case that houses the reactor body, and the case has sidewalls to which the mount portions are provided.

3. The reactor according to claim 2, wherein the fixing portions are integrally molded to the resin member continuously from a location where the resin member covers the core.

4. A reactor comprising:

a reactor body having a core and a resin member that covers a circumference of the core; and an installation destination object on which the reactor body is mounted; wherein the reactor body has three fixing portions for fixing the reactor body to the installation destination object, at least one of the fixing portions having an extending portion formed by extending the resin member, the installation destination object has mount portions for mounting the fixing portions, the extending portion is flexible in at least one direction among a height direction of the reactor and a lateral direction vertical to the height direction, a screw through-hole to be fastened with the mount portion is formed at a tip of the extending portion, the reactor body is fixed to the installation destination object by the fixing portions being mounted on the mount portions, two or more fixing portions have extending portions, and lengths of the extending portions are different from each other.

5. The reactor according to claim 2, wherein upper edges of the sidewalls of the case form an approximately quadrangle opening, and the mount portions are provided at corner portions of the case, the corner portions being formed by two of the sidewalls.

6. The reactor according to claim 5, wherein the core is an annular core including:

two or more leg portions configured with I-shaped cores; and a pair of yoke portions arranged at both end portions of the leg portions, and the extending portion is formed in a direction extending outward from a bent portion of the yoke portion and mounted to the mount portions provided at the corner portions of the case.

7. The reactor according to claim 6, wherein the mount portions are formed by projecting the sidewalls toward an inside of the case, and screw holes for mounting the fixing portions are provided at tips of the mount portions.

8. A reactor comprising:

a reactor body having a core and a resin member that covers a circumference of the core; and an installation destination object on which the reactor body is mounted; wherein the reactor body has three fixing portions for fixing the reactor body to the installation destination object, at least one of the fixing portions having an extending portion formed by extending the resin member, the installation destination object has mount portions for mounting the fixing portions, the extending portion is flexible in at least one direction among a height direction of the reactor and a lateral direction vertical to the height direction, a screw through-hole to be fastened with the mount portion is formed at a tip of the extending portion, the reactor body is fixed to the installation destination object by the fixing portions being mounted on the mount portions, the fixing portions include protruding portions at the tips of the extending portions, the protruding portions projecting toward the installation destination object from the extending portions in the lateral direction and projecting in the height direction of the reactor, and the mount portions include positioning holes, into which the protruding portions are inserted, at top surface portions of sidewalls of the installation destination object.

9. The reactor according to claim 2, wherein the extending portion is more flexible in the height direction of the reactor than in the lateral direction of the reactor.

10. The reactor according to claim 1, wherein the portion of the extending portion is longer than or equal to twice the minimum width of the edge portion around the screw through-hole.

11. The reactor according to claim 2, wherein the sidewalls are flexible.

12. The reactor according to claim 2, wherein the mount portions are provided on top surface portions of the sidewalls, and the case has an opening formed by upper edges of the sidewalls, the opening deforming due to a linear expansion difference between the reactor body and the case.

13. The reactor according to claim 2, further comprising:

a coil fit to the resin member so as to wind around the circumference of the core; and a bus bar whose one end is electrically connected with the coil and another end is electrically connected with an external device by fastening, wherein two of the fixing portions are provided at both sides of the bus bar.

14. The reactor according to claim 2, wherein the case is made with any of aluminum, resin, iron, magnesium and zinc or two or more types of these.

15. The reactor according to claim 2, wherein the core is an annular core including:

two or more leg portions configured with I-shaped cores; and a pair of yoke portions arranged at both end portions of the leg portions, the three fixing portions are a first fixing portion, a second fixing portion and a third fixing portion, and the third fixing portion is provided to the resin member on a side of one of the yoke portions, and the first fixing portion and the second fixing portion are provided to the resin member on a side of another one of the yoke portions.

16. A reactor comprising:

a reactor body and;

a case that is substantially rectangular and houses the reactor body, wherein the reactor body has:

a core;

a resin member that covers a circumference of the core; and no more and no less than three fixing portions for fixing the reactor body to the case, at least one of the fixing portions having an extending portion formed by extending the resin member, and the case has:

sidewalls that are flexible; and mount portions for mounting the fixing portions, wherein the core is an annular core including:

two or more leg portions; and a pair of yoke portions arranged at both end portions of the leg portions, each yoke portion having a bent portion, the extending portion is formed in a direction extending outward from the bent portion of the yoke portion, the extending portion is flexible in at least one direction among a height direction of the reactor and a lateral direction vertical to the height direction, a screw through-hole to be fastened with the mount portion is formed at a tip of the extending portion, the reactor body is fixed to the case by the fixing portions being mounted on the mount portions, at least a portion of the extending portion is longer than a minimum width of an edge portion around the screw through-hole formed in the extending portion, and the edge portion around the screw through-hole is thicker than any other portion of the extending portion.

17. A reactor comprising:

a reactor body and;

a case that is substantially rectangular and houses the reactor body, wherein the reactor body has:

a core;

a resin member that covers a circumference of the core; and no more and no less than three fixing portions for fixing the reactor body to the case, at least one of the fixing portions having an extending portion formed by extending the resin member, and the case has:

sidewalls that are flexible; and mount portions for mounting the fixing portions, wherein the core is an annular core including:

two or more leg portions; and a pair of yoke portions arranged at both end portions of the leg portions, each yoke portion having a bent portion, the extending portion is formed in a direction extending outward from the bent portion of the yoke portion, the extending portion is flexible in at least one direction among a height direction of the reactor and a lateral direction vertical to the height direction, a screw through-hole to be fastened with the mount portion is formed at a tip of the extending portion, the reactor body is fixed to the case by the fixing portions being mounted on the mount portions, two or more fixing portions have extending portions, and lengths of the extending portions are different from each other.

18. A reactor comprising:

a reactor body and;

a case that is substantially rectangular and houses the reactor body, wherein the reactor body has:

a core;

a resin member that covers a circumference of the core; and no more and no less than three fixing portions for fixing the reactor body to the case, at least one of the fixing portions having an extending portion formed by extending the resin member, and the case has:

sidewalls that are flexible; and mount portions for mounting the fixing portions, wherein the core is an annular core including:

two or more leg portions; and a pair of yoke portions arranged at both end portions of the leg portions, each yoke portion having a bent portion, the extending portion is formed in a direction extending outward from the bent portion of the yoke portion, the extending portion is flexible in at least one direction among a height direction of the reactor and a lateral direction vertical to the height direction, a screw through-hole to be fastened with the mount portion is formed at a tip of the extending portion, the reactor body is fixed to the case by the fixing portions being mounted on the mount portions, the fixing portions include protruding portions at the tips of the extending portions, the protruding portions projecting toward the case from the extending portions in the lateral direction and projecting in the height direction of the reactor, and the mount portions include positioning holes, into which the protruding portions are inserted, at top surface portions of the sidewalls.

* * * * *